US012082663B2

(12) United States Patent
Law

(10) Patent No.: US 12,082,663 B2
(45) Date of Patent: Sep. 10, 2024

(54) ARTICULATED CROSS PENDANT

(71) Applicant: Donna Law, Phoenix, AZ (US)

(72) Inventor: Donna Law, Phoenix, AZ (US)

( * ) Notice: Subject to any disclaimer, the term of this patent is extended or adjusted under 35 U.S.C. 154(b) by 66 days.

(21) Appl. No.: 17/479,945

(22) Filed: Sep. 20, 2021

(65) Prior Publication Data

US 2022/0000226 A1 Jan. 6, 2022

Related U.S. Application Data

(63) Continuation-in-part of application No. 16/719,472, filed on Dec. 18, 2019, now Pat. No. 11,122,871.

(60) Provisional application No. 62/781,158, filed on Dec. 18, 2018.

(51) Int. Cl.
*A44C 25/00* (2006.01)
*A44C 15/00* (2006.01)

(52) U.S. Cl.
CPC ..... *A44C 25/001* (2013.01); *A44C 25/005* (2013.01)

(58) Field of Classification Search
CPC ..... A44C 25/005; A44C 25/007; A44C 25/00
USPC ..... 63/21, 23; D11/79, 85, 96
See application file for complete search history.

(56) References Cited

U.S. PATENT DOCUMENTS

| | | | | |
|---|---|---|---|---|
| 770,573 | A | 9/1904 | Hacherelle | |
| 1,032,257 | A | 7/1912 | Walrow | |
| 1,052,980 | A | 2/1913 | Smith | |
| 1,103,422 | A | 7/1914 | Kluge | |
| 1,638,743 | A | 8/1927 | Peterson et al. | |
| D131,325 | S * | 2/1942 | Cooper | 63/38 |
| D160,626 | S * | 10/1950 | Katz | D11/8 |
| D252,805 | S * | 9/1979 | Mitchum | D99/27 |
| D567,697 | S * | 4/2008 | Kitamura | D11/3 |
| D937,566 | S * | 12/2021 | Dumas | D3/215 |
| 2004/0007017 | A1 * | 1/2004 | Flaherty | A44C 15/005 63/3.1 |
| 2013/0036768 | A1 | 2/2013 | Hernandez | |
| 2016/0302537 | A1 * | 10/2016 | Kinsella | A44C 15/005 |

* cited by examiner

*Primary Examiner* — Jack W Lavinder
(74) *Attorney, Agent, or Firm* — Schmeiser, Olsen & Watts LLP

(57) ABSTRACT

The disclosed articulated cross pendant according to various embodiments may comprise a necklace capable of being worn around the neck of a user and a cross pendant attachable to the necklace. The cross pendant may comprise a first component and a second component. The first component may comprise a first bar and a second bar orthogonally coupled to the first bar. The second bar may comprise a first arm and a second arm extending in an opposite direction form the first arm. The second component may be attachable to the first component and may comprise a ring and a third arm coupled to the ring. The first bar may extend through the ring.

9 Claims, 5 Drawing Sheets

ARTICULATED CROSS PENDANT

CROSS REFERENCE TO RELATED APPLICATION

This application is a continuation-in-part of U.S. patent application Ser. No. 16/719,472, filed Dec. 18, 2019, which claims benefit of U.S. provisional patent application 62/781,158 filed Dec. 18, 2018, the disclosures of which are hereby incorporated entirely herein by reference.

BACKGROUND OF THE TECHNOLOGY

A cross necklace typically features a Christian cross pendant or crucifix worn by Christians and others. Conventional cross pendants are shaped as a cruciform having an upright bar traversed by a horizontal bar. Conventional cross pendants typically comprise an elongated descending arm of the upright bar where the descending arm is longer than the ascending arm of the upright bar and longer than each of the arms of the horizontal bar.

A common problem with many cross pendants worn on a necklace, and particularly on a short necklace of about 18 inches or less, or of choker length, worn high on the chest near the crease of the neck or on the neck itself, is that the top and bottom ends of the upright bar tend to catch in the folds of skin or crease of the neck when the user bows the head downward toward the chest, thereby poking the top and bottom ends of the cross into the skin of the upper chest or neck. This can be painful for the user, and, in some cases, risks piercing the skin.

Accordingly, what is needed is an improved cross pendant that articulates and may be worn on a necklace high on the chest near the crease of the neck or on the neck itself that does not catch in the folds of skin or crease of the neck when the user bows her head downward toward her chest.

SUMMARY OF THE TECHNOLOGY

The disclosed cross pendant assembly according to various embodiments may comprise a necklace capable of being worn around the neck of a user and a cross pendant attachable to the necklace. The cross pendant may comprise a first component and a second component. The first component may comprise a first bar and a second bar orthogonally coupled to the first bar. The second bar may comprise a first arm and a second arm extending in an opposite direction form the first arm. The second component may be attachable to the first component and may comprise a ring and a third arm coupled to the ring. The first bar may extend through the ring.

BRIEF DESCRIPTION OF THE DRAWINGS

A more complete understanding of the present technology may be derived by referring to the detailed description and claims when considered in connection with the following illustrative figures. In the following figures, like reference numbers refer to similar elements and steps throughout the figures.

DETAILED DESCRIPTION OF EXEMPLARY EMBODIMENTS

Figure 1:
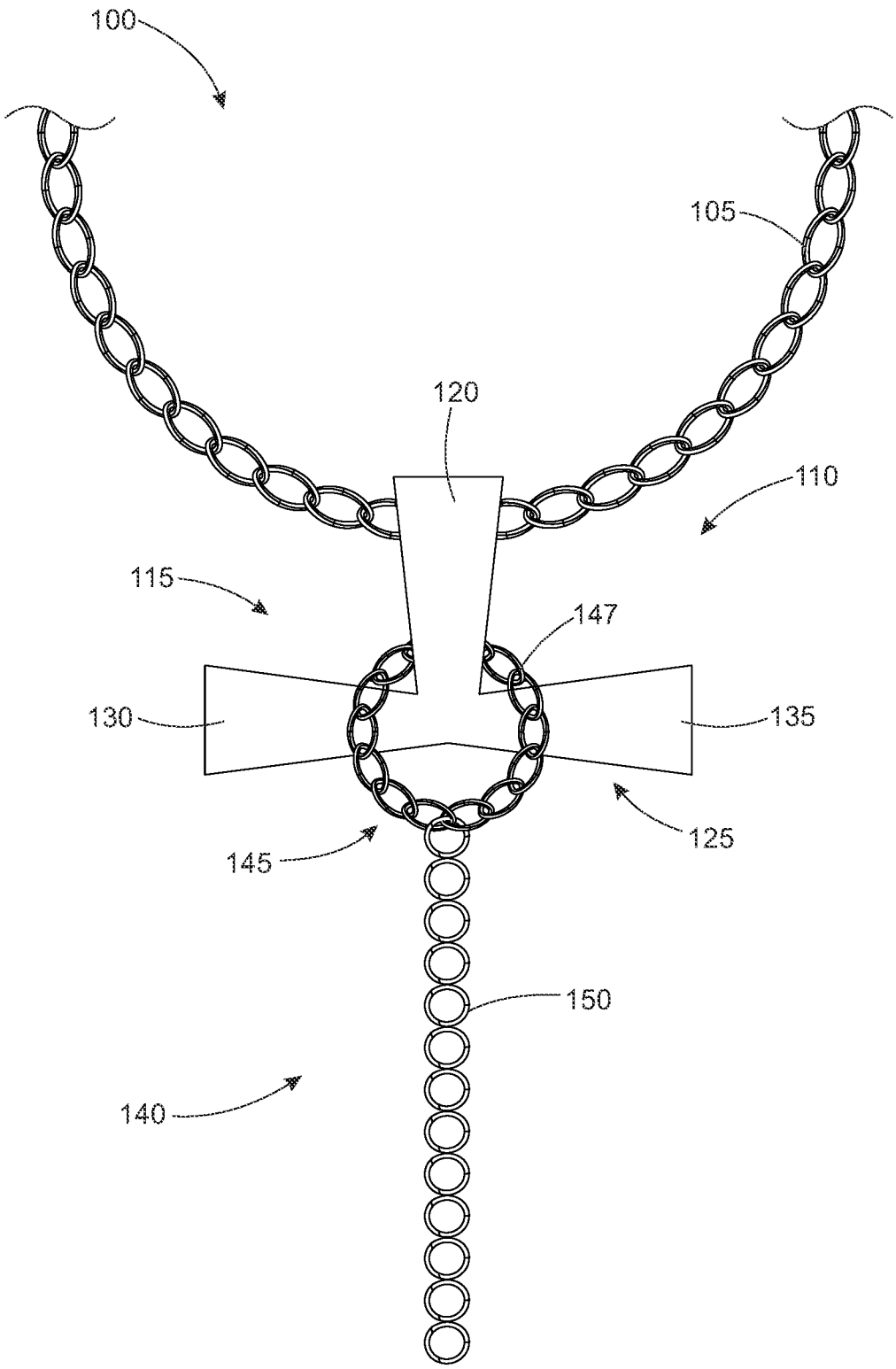
FIG. 1 representatively illustrates a front view of a cross pendant assembly in accordance with a first embodiment of the present technology.

The present technology may be described herein in terms of functional block components. Such functional blocks may be realized by any number of components configured to perform the specified functions and achieve the various results. For example, the present technology may employ various cross pendants, necklaces, joints, hinges, hooks, loops, and the like, which may carry out a variety of functions. In addition, the present technology may be practiced in conjunction with any number of necklaces, bookmarks, bracelets, ornament loops, keychain loops, rings, earrings, and the like, and the cross pendant assembly described herein is merely one exemplary application for the technology.

Referring to FIGS. 1-5, a cross pendant assembly 100 may comprise a necklace 105 capable of being worn around the neck of a user and a cross pendant 110 which may be attachable to the necklace 105. The cross pendant 110 be suitably configured to articulate such that it may be worn, via the necklace 105, high on the chest of the user near the crease of the neck or on the neck itself without catching in the folds of the skin of the user or the crease of the neck when the user bows her head downward toward her chest.

In various embodiments, the cross pendant 110 may comprise a first component 115. The first component 115 may comprise a first bar 120 and a second bar 125. The second bar 125 may be orthogonally coupled to the first bar 120 and may comprise a first arm 130 and a second arm 135 extending in an opposite direction from the first arm 130. The cross pendant 110 may also comprise a second component 140. The second component 140 may be capable of being suspended from the first component 115 and may comprise a ring 145 and a third arm 150 coupled to the ring 145, where the first bar 120 may extend through the ring 145.

In one embodiment, the first arm 130 and the second arm 135 may each be solid, and the third arm 150 may be articulated. For example, FIGS. 1-3 and 5 representatively illustrate non-limiting examples of an articulated third arm 150. Accordingly, the cross pendant 110 may maintain its shape in the form of the cross when the user raises her head, but the third arm 150 may flex when the user bows her head downward toward her chest. In this regard, when the third arm 150 contacts corresponding surfaces of the chin, neck, and/or chest of the user, the third arm 150 may articulate so that it does not poke or pierce the skin of the user when the user bows her head downward toward her chest.

In some embodiments, the first bar 120 may be fixedly connected to the second bar 125, such as shown in FIGS. 1-3 and 5. In other embodiments, the first bar 120 may be coupled to the second bar 125 via a first articulating joint 155, where the first articulating joint 155 may be integrally formed on at least one of the first bar 120 or second bar 125, such as shown in FIG. 4. In this embodiment, the third arm 150 may be coupled to the second bar 125 instead of the ring 145. The third arm 150 may comprise a first link 155*a* and a second link 155*b*. The first link 155*a* may be coupled to the second bar 125 via a second articulating joint 160, where the second articulating joint 160 may be integrally formed on at least one of the second bar 125 or the first link 155*a* of the third arm 150. In addition, the second link 155*b* may be coupled to the first link 155*a* via a third articulating joint 165, where the third articulating joint 165 may be integrally formed on at least one of the first link 155*a* or the second link 155*b*. Each articulating joint 155, 160, 165 may comprise any suitable joint, such as a pin joint, or the like.

Figure 2:
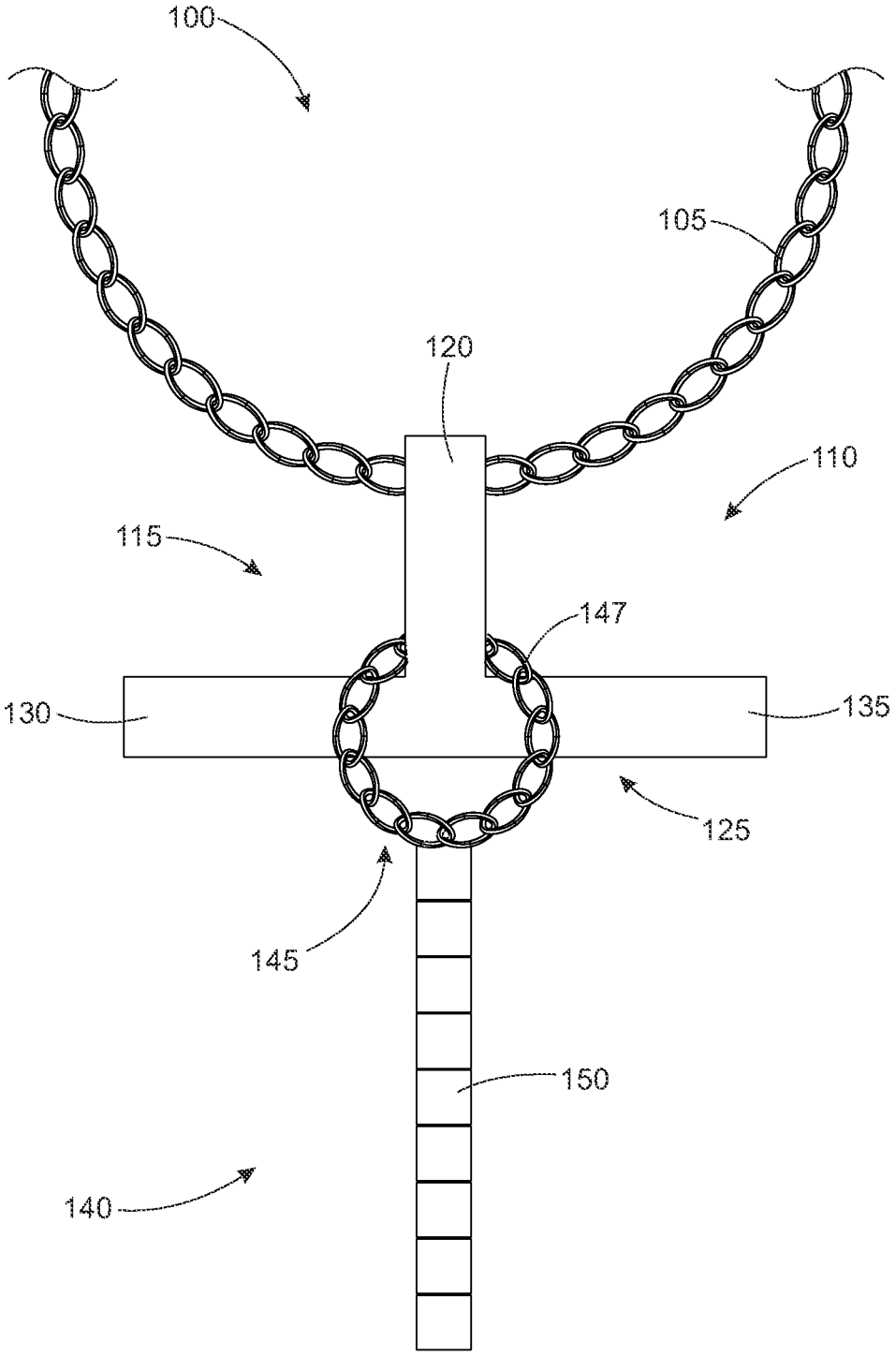
FIG. 2 representatively illustrates a front view of a cross pendant assembly in accordance with a second embodiment of the present technology.
Figure 3:
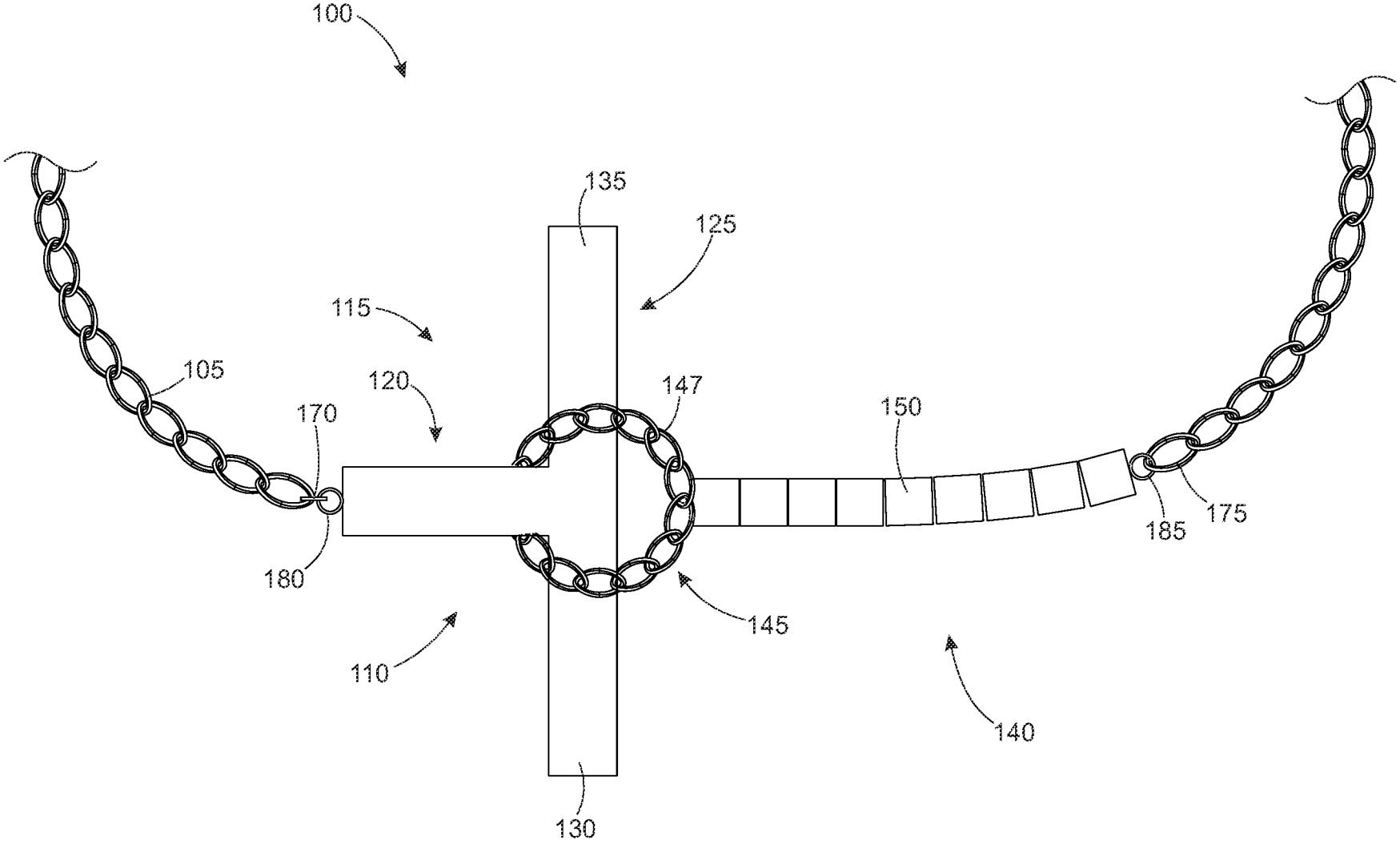
FIG. 3 representatively illustrates a front view of a cross pendant assembly in accordance with a third embodiment of the present technology.
Figure 4:
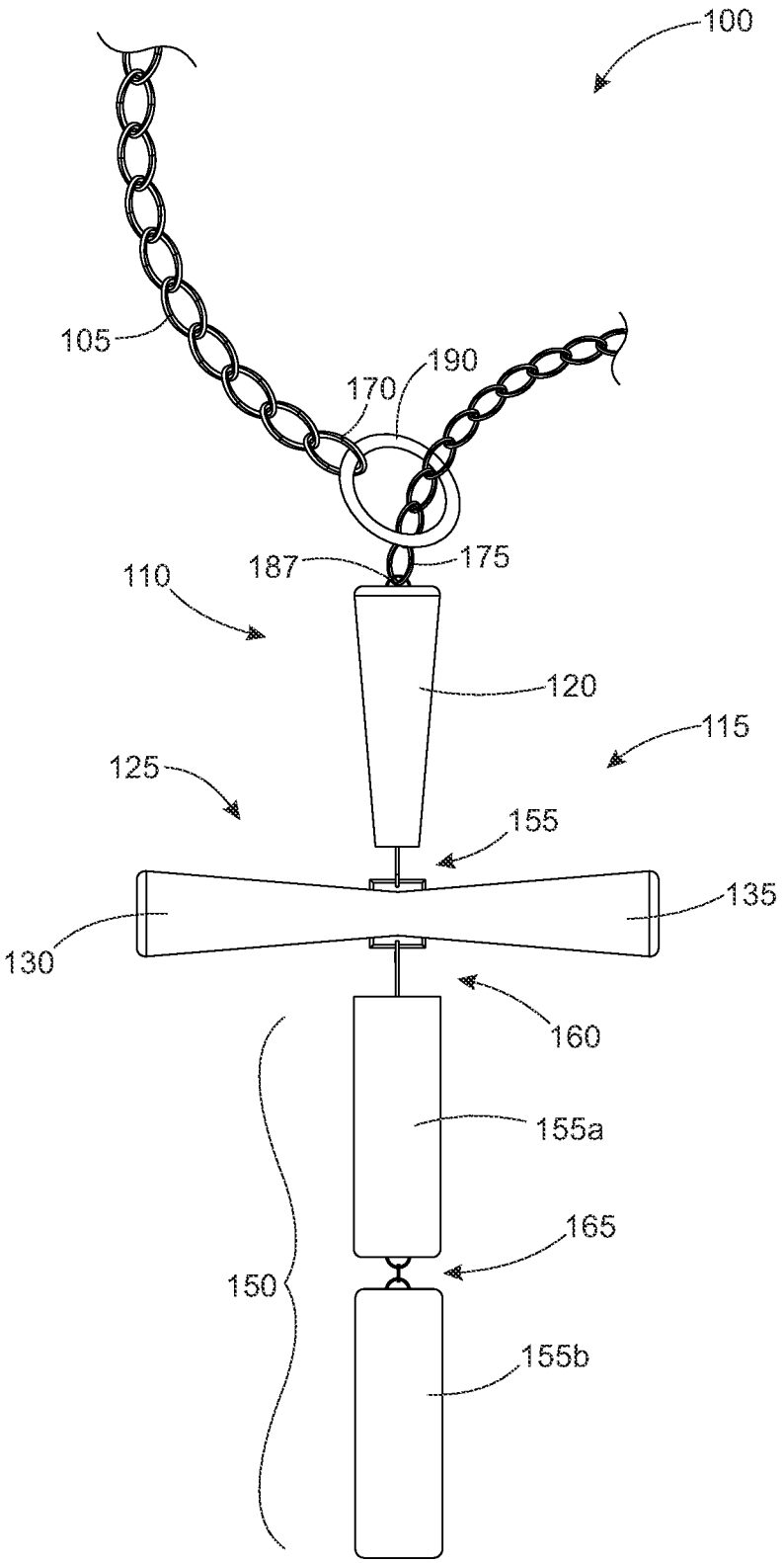
FIG. 4 representatively illustrates a front view of a cross pendant assembly in accordance with a fourth embodiment of the present technology.
Figure 5:
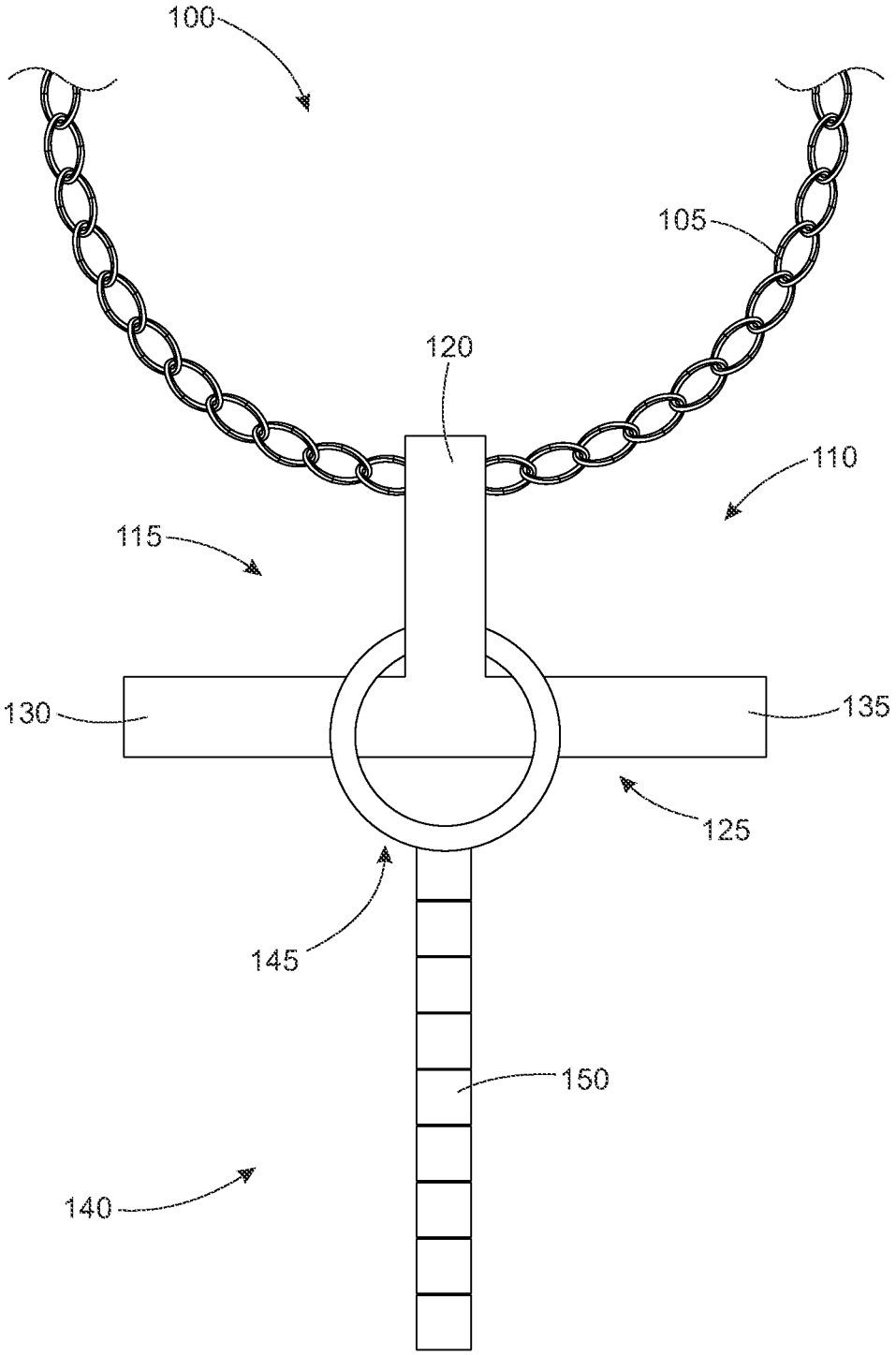
FIG. 5 representatively illustrates a front view of a cross pendant assembly in accordance with a fifth embodiment of the present technology.

The ring 145 may comprise any suitable size and shape so long as the first bar may extend through the ring 145, such as shown in FIGS. 1-3 and 5. It will be appreciated that modifications may be made to the ring 145 without departing from the scope of the invention. For example, in one embodiment, the ring 145 may comprise a plurality of links 147 coupled to each other, such as shown in FIG. 1-3. In some embodiments, the links 147 may be interlinked with each other. In an alternative embodiment, the ring 145 may be solid, such as shown in FIG. 5.

The necklace 105 may comprise a first end 170 and a second end 175 opposite the first end 170 and may be connected to the cross pendant 110 in any suitable manner. For example, in one embodiment, the first bar 120 may comprise an aperture (not shown) formed therein so that the necklace 105 may pass through the aperture (not shown). In an alternative embodiment, the first bar 120 may comprise a first attachment ring 180 fixedly coupled thereto, and the third arm 150 may comprise a second attachment ring 185 fixedly coupled thereto. The first and second ends 170, 175 of the necklace 105 may be coupled to the first and second attachment rings 180, 185 respectively.

In yet another embodiment, and referring now to FIG. 4, the cross pendant 110 may further comprise a third attachment ring 187 coupled to the first bar 120, where the second end 175 of the necklace 105 may be coupled to the third attachment ring 187. In addition, the first end 170 of the necklace 105 may comprise a loop 190. The loop 190 may comprise any suitable diameter so long as the cross pendant 110 may be inserted through the loop 190. In this regard, when the necklace 105 is placed around the neck of the user, the cross pendant 110 may be pulled downward toward the chest of the user so that it extends through the loop 190, such as shown in FIG. 4. Because the length of the second bar 125 may be greater than the diameter of the loop 190, the cross pendant 110 may be securely worn around the neck of the user.

The necklace 105 may comprise any suitable necklace, such as a choker-style necklace, and the like. For example, in one embodiment, the necklace 105 may be a choker-style necklace having a length of 18 inches or less. Further, it will be appreciated that modifications may be made to the necklace 105 without departing from the scope of the invention. For example, instead of the necklace 105, a bookmark (not shown), a bracelet (not shown), an ornament loop (not shown), a keychain loop (not shown), a ring (not shown), an earring (not shown), or the like may be attached to the cross pendant 110.

The cross pendant 110 may comprise a variety of suitable jewels, such as precious or semi-precious stones, and the like, attached to any component of an articulated cross pendant 110, by any means known by a person of ordinary skill in the art, now or in the future. Furthermore, embodiments of the present invention may comprise any of a variety of designs incorporated onto or into any component of a cross pendant 110, such as by coloring, etching, piercing, shaping, molding, or otherwise, by any means known by a person of ordinary skill in the art, now or in the future, so long as such incorporation of designs is consistent with the intended functionality of the cross pendant 110, as described above.

Manufacturing the various components of the cross pendant assembly 100 may comprise performing any or all of the following: extrusion, pultrusion, vacuum formation, injection molding, blow molding, resin transfer molding, casting, forging, cold rolling, milling, drilling, reaming, turning, grinding, stamping, cutting, bending, welding, soldering, hardening, riveting, punching, plating, and the like. In addition, the various components of the cross pendant assembly 100 may be made of many different types of materials or combinations thereof that can readily be formed into shaped objects provided that the components selected are consistent with the intended operation of the articulated cross pendant 110 described above.

As an example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as gold, silver, copper, zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; precious stones, such as diamond, ruby, sapphire, emerald, any combination thereof, and/or other like materials; semi-precious stones, non-precious stones, any combination thereof, and/or other like materials; any other suitable material; and/or any combination thereof.

It will be appreciated that, in some embodiments, the present disclosure may further provide a kit-of-parts for a cross pendant assembly as described herein, where the kit-of-parts may comprise at least one necklace as described herein and at least one cross pendant as described herein. The kit-of-parts may comprise separate components adapted to be assembled by the end consumer. In some cases, the kit-of-parts may reduce waste material, thereby increasing cost-efficiency and reducing the time necessary to manufacture the components of the cross pendant assembly. It will also be appreciated that, in other embodiments, any or all the components may be manufactured simultaneously and integrally joined with one another by the manufacturer.

In the foregoing specification, the technology has been described with reference to specific exemplary embodiments. Various modifications and changes may be made, however, without departing from the scope of the present technology as set forth in the claims. The specification and figures are illustrative, rather than restrictive, and modifications are intended to be included within the scope of the present technology. Accordingly, the scope of the technology should be determined by the claims and their legal equivalents rather than by merely the examples described. For example, the components and/or elements recited in any apparatus claims may be assembled or otherwise operationally configured in a variety of permutations and are accordingly not limited to the specific configuration recited in the claims. Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise," "comprises," "comprising," "having," "including," "includes," or any variation thereof, are intended to reference a non-exclusive inclusion, such that a process, method, article, composition or apparatus that comprises a list of elements does not include only those elements recited but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied, or otherwise particularly adapted to specific environments, manufacturing specifications, design parameters or other operating requirements without departing from the general principles of the same.

The invention claimed is:

1. A cross pendant, comprising:
- a first component, comprising:
  - a first bar; and
  - a second bar orthogonally coupled to the first bar and comprising:
    - a first arm; and
    - a second arm extending in an opposite direction from the first arm; and
- a second component attachable to the first component and comprising:
  - a ring having an opening receiving the first bar therein, wherein the first bar extends through the opening of the ring, wherein the ring is suspended from the first bar and lays against the first and second arms of the second bar, and wherein the ring is free to move along a length of the first bar; and
  - a third arm having first and second ends and coupled to the ring, wherein the third arm is articulately coupled relative to the ring with the first end thereof and is configured to be suspended from the ring in a downward direction, wherein the second end of the third arm is a free end extending downwardly from the ring.

2. The cross pendant of claim 1, wherein the ring comprises a plurality of links coupled to each other.

3. The cross pendant of claim 1, wherein the ring is solid.

4. The cross pendant of claim 1, wherein each of the first arm and the second arm is solid.

5. A cross pendant assembly, comprising:
- a necklace configured to be worn around a neck of a user and comprising:
  - a first end; and
  - a second end; and
- a cross pendant attachable to the necklace and comprising:
  - a first component, comprising:
    - a first bar, wherein the first bar is attachable to the necklace at one end thereof; and
    - a second bar orthogonally coupled to the first bar and comprising:
      - a first arm; and
    - a second arm extending in an opposite direction from the first arm; and
- a second component attachable to the first component and comprising:
  - a ring having an opening receiving the first bar therein, wherein the first bar extends through the opening in the ring, wherein the ring is suspended from the first bar and lays against the first and second arms of the second bar, and wherein the ring is free to move along a length of the first bar; and
  - a third arm having first and second ends and coupled to the ring, wherein the third arm is articulately coupled relative to the ring with the first end thereof and is configured to be suspended from the ring in a downward direction, wherein the second end of the third arm is a free end extending downwardly from the ring.

6. The cross pendant assembly of claim 5, wherein each of the first arm and the second arm is solid.

7. The cross pendant assembly of claim 5, wherein the necklace is a choker-style necklace having a length of 18 inches or less.

8. The cross pendant assembly of claim 5, wherein the ring comprises a plurality of links coupled to each other.

9. The cross pendant assembly of claim 5, wherein the ring is solid.

* * * * *